US008714211B1

(12) United States Patent
Schaefer

(10) Patent No.: US 8,714,211 B1
(45) Date of Patent: May 6, 2014

(54) SAND BAG FILLER WITH MULTIPLE FILL STATIONS

(71) Applicant: Richard Floyd Schaefer, Fort Lupton, CO (US)

(72) Inventor: Richard Floyd Schaefer, Fort Lupton, CO (US)

( * ) Notice: Subject to any disclaimer, the term of this patent is extended or adjusted under 35 U.S.C. 154(b) by 0 days.

(21) Appl. No.: 14/014,880

(22) Filed: Aug. 30, 2013

(51) Int. Cl.
*B65B 1/04* (2006.01)

(52) U.S. Cl.
USPC ..... 141/317; 141/10; 141/166

(58) Field of Classification Search
CPC ..... B65B 1/06; B65B 3/06; B65B 39/003
USPC ..... 141/10, 114, 166, 234, 238–239, 241, 141/247, 313, 314, 317, 331
See application file for complete search history.

(56) References Cited

U.S. PATENT DOCUMENTS

| | | | | |
|---|---|---|---|---|
| 4,044,921 | A | 8/1977 | Caverly | |
| 5,168,906 | A | 12/1992 | Combrink | |
| 5,215,127 | A * | 6/1993 | Bergeron | 141/10 |
| 5,417,261 | A | 5/1995 | Kanzler et al. | |
| 5,547,331 | A | 8/1996 | Podd et al. | |
| 5,575,315 | A | 11/1996 | Wengert | |
| 5,687,781 | A | 11/1997 | Grizz | |
| 5,701,937 | A | 12/1997 | Bourboulou et al. | |
| 5,771,665 | A | 6/1998 | Nelson et al. | |
| 5,806,576 | A | 9/1998 | Sutherlin | |
| 5,845,685 | A | 12/1998 | Cooper | |
| 5,848,625 | A * | 12/1998 | Ebert | 141/246 |
| 5,873,396 | A | 2/1999 | Biebrach et al. | |
| 5,927,356 | A | 7/1999 | Henderson | |
| 5,957,172 | A | 9/1999 | DeGreef et al. | |
| 5,988,237 | A | 11/1999 | Bedsole | |
| 6,047,748 | A | 4/2000 | Rooker | |
| 6,085,810 | A | 7/2000 | Castillo et al. | |
| 6,105,640 | A * | 8/2000 | Holand et al. | 141/391 |
| 6,119,740 | A | 9/2000 | Wilham, Jr. et al. | |
| 6,161,600 | A | 12/2000 | Borkes | |
| 6,269,849 | B1 | 8/2001 | Fields, Jr. | |
| 6,374,874 | B1 | 4/2002 | Payne | |
| 6,662,528 | B2 | 12/2003 | Holt et al. | |
| 6,863,945 | B2 | 3/2005 | Beitz et al. | |
| 6,932,126 | B1 | 8/2005 | Spagnolo | |
| 7,665,489 | B1 | 2/2010 | Smith | |
| 7,942,171 | B2 | 5/2011 | Hartley, III | |
| 7,954,520 | B2 | 6/2011 | England | |
| 2001/0032442 | A1 | 10/2001 | Holt et al. | |
| 2010/0022361 | A1 | 1/2010 | Raines et al. | |
| 2011/0005636 | A1 | 1/2011 | Hartley, III et al. | |
| 2011/0067780 | A1 | 3/2011 | Kellly et al. | |
| 2012/0132316 | A1 | 5/2012 | Nielsen | |
| 2012/0279610 | A1 | 11/2012 | Krum | |
| 2013/0092283 | A1 | 4/2013 | Votel et al. | |

* cited by examiner

*Primary Examiner* — Jason K Niesz
(74) *Attorney, Agent, or Firm* — Russell T. Manning; Marsh Fischmann Breyfogle, LLP

(57) ABSTRACT

An apparatus and methodology is provided for filling portable containers, such as sandbags, with aggregate materials. The utility utilizes a transfer mechanism to selectively transfer aggregate between a supply of aggregate material (e.g., sand) and first and second filling stations that direct received aggregate into portable containers or bags. The transfer mechanism is operative to alternately supply aggregate between the first and second filling stations and operates primarily under the force of gravity.

21 Claims, 6 Drawing Sheets

SAND BAG FILLER WITH MULTIPLE FILL STATIONS

FIELD OF THE INVENTION

The present disclosure relates to an apparatus and method for mechanically filling sandbags, for instance, at a site where sandbags are to be piled for flood control. More particularly, the disclosure relates to a mechanical system and method that provides two or more filling stations to fill sand or aggregate bags from a single supply source.

BACKGROUND

Sand bags are commonly filled using shovels or hand implements so that they can be piled for flood control. Due to the hard labor required and, in some instances, the short time available in emergency conditions, it is desirable to have a more automated means of filling sandbags.

Some prior art semi-automated systems have employed a sand hopper having an outlet chute that allows a bag to be positioned to receive sand from the outlet chute. In such systems, a manual gate or valve is typically utilized to permit sand or aggregate to flow through the outlet chute and into the bag. Such systems also require closing the gate or valve once the bag is filled and commonly result in spillage of sand due to overfilling. Further, such prior systems have limited throughput as a filled bag must be removed from the chute in order to reposition another empty bag relative to the chute. During the removal and repositioning of the bags, such systems sit idle.

A number of fully automated sag bag filling devices have also been proposed. However, such fully automated sand bag filling devices are mechanically complex and typically expensive. Accordingly, adoption of such fully automated devices has been limited.

SUMMARY

Generally, an apparatus and method (i.e., utility) is provided for filling portable containers, such as sandbags, with aggregate materials. The utility utilizes a transfer mechanism to selectively transfer aggregate between a supply of aggregate material (e.g., sand) and first and second filling stations that direct received aggregate into portable containers or bags. The transfer mechanism is operative to alternately supply aggregate between the first and second filling stations and operates primarily under the force of gravity. That is, the weight of the aggregate received by the transfer mechanism moves the transfer mechanism between first and second positions to provide aggregate material to the first and second filling stations. Further, the transfer mechanism provides a metered amount of aggregate.

The utility includes a supply hopper having an inlet and an outlet. Aggregate material received by the inlet of the supply hopper drains through the outlet. A carriage located beneath the supply hopper supports first and second transfer hoppers, which are selectively positionable beneath the outlet of the supply hopper. The first and second transfer hoppers are adapted to alternately rotate between the supply hopper outlet and the inlets of first and second filling stations or bag filling hoppers, respectively. The outlets of the bag filling hoppers are adapted to receive portable storage containers (hereafter 'bags' or 'sandbags'). In operation, the carriage moves between first and second positions to move the transfer hoppers between the supply hopper outlet and their respective bag filling hopper. In the first position, the first transfer hopper is positioned beneath the outlet of supply hopper to receive aggregate material and the second transfer hopper is tilted over an inlet of the second bag filling hopper to dump or spill aggregate into the second bag filling hopper. Once the first transfer hopper is filled with aggregate and the second transfer hopper is at least partially emptied, the carriage rotates to a second position where the first transfer hopper is tilted over the first bag filling hopper and the second transfer hopper is disposed beneath the outlet of the supply hopper.

Each transfer hopper includes an open end to receive aggregate material into a close ended volume. The volume of the transfer hoppers may be sized to receive a predetermined amount of aggregate, which may be matched to a size of a container/bag that will be filled. In one arrangement, the volumes of the transfer hoppers are sized to hold approximately 40 pounds of dry sand. However, this is not a requirement. While the transfer hoppers are upright beneath the supply hopper outlet, the aggregate is maintained within the volume. When the transfer hoppers are tilted, aggregate material within the volume flows back out of the open end.

The carriage supports the first and second transfer hoppers at first and second angular positions relative to the rotational axis of the carriage. The first and second angular positions are offset by at least 90°. More preferably, the first and second hoppers are offset by at least 100° and yet more preferably by at least 110°. In this regard, when one transfer hopper is positioned upright beneath the outlet of the supply hopper to receive aggregate, the other transfer hopper is rotated at least partially downward to allow aggregate material to flow out. In a further arrangement, a radial surface extends between open ends of the first and second transfer hoppers. In such an arrangement, the radial surface may be positioned beneath the supply hopper outlet as the carriage moves between the first and second positions. Disposition of the radial surface beneath the supply hopper outlet impedes flow of aggregate out of the supply hopper as the carriage moves between the first and second positions.

In one arrangement, the geometric centers or centroids of the first and second volumes of the transfer hoppers are laterally offset on opposing sides of the pivot point/rotational axis of the carriage. In this regard, when aggregate material flows into a transfer hopper positioned beneath the supply hopper outlet, the center of mass of the aggregate in the transfer hopper is laterally offset from the rotational axis of the carriage. This lateral offset of the aggregate mass causes the carriage to rotate moving the filled transfer hopper from position beneath the supply hopper outlet to a tilted or spill position above its respective bag filling hopper. Stated otherwise, the weight of the aggregate material in the filled hopper, acting under the force of gravity, overcomes the weight of the other emptied transfer hopper and rotates the carriage. Further, this rotates the emptied transfer hopper to the position beneath the supply hopper outlet where it is refilled.

In a further arrangement, the carriage includes locking member or latches that maintain the carriage in the first and second positions. Such latches, prevent the carriage from rotating until a user releases the latch. In this regard, a filled transfer hopper may not dump its contents until a user is ready.

DETAILED DESCRIPTION

Reference will now be made to the accompanying drawings, which at least assist in illustrating the various pertinent features of the presented inventions. The following description is presented for purposes of illustration and description and is not intended to limit the inventions to the form disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

Figure 1:
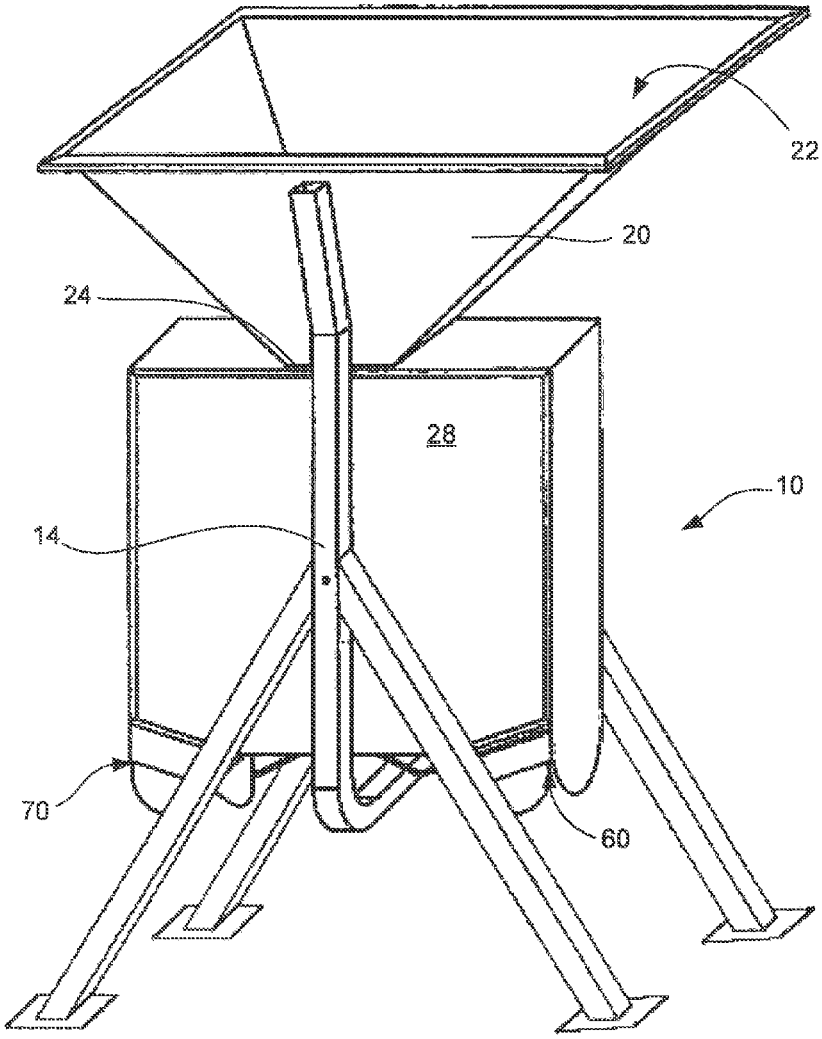
FIG. 1 shows a perspective view of a first embodiment of an aggregate filling apparatus.

FIG. 1 illustrates a sandbagging apparatus 10 that allows for efficiently filling at least first and second sandbags or other portable containers with aggregate from a single source. More specifically, the apparatus 10 transfers sand or other aggregate materials between a supply hopper 20 and first and second filling stations 60, 70. A transfer mechanism 28 alternately provides sand or aggregate (hereafter 'sand') to one of the first and second filling stations 60, 70. Of note, the transfer mechanism 28 is a gravity powered mechanism that alternates the supply of sand between first and second bag filling stations 60, 70 without a powered actuator (e.g., motor). That is, the weight of the sand provided from the supply hopper 20 operates the transfer mechanism 28. In operation, the apparatus allows for increasing throughput of a sandbagging device by providing multiple filling stations, which reduces idle time between filling of sandbags.

Figure 2B:
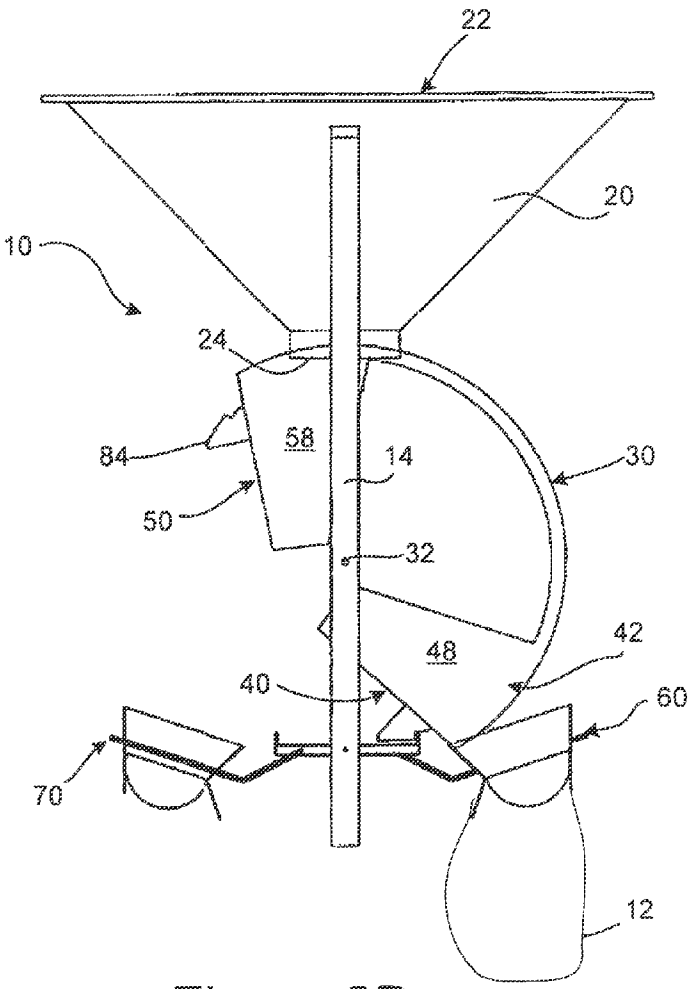
FIG. 2B shows a side view of the aggregate filling apparatus of FIG. 1 in a second position.
Figure 2A:
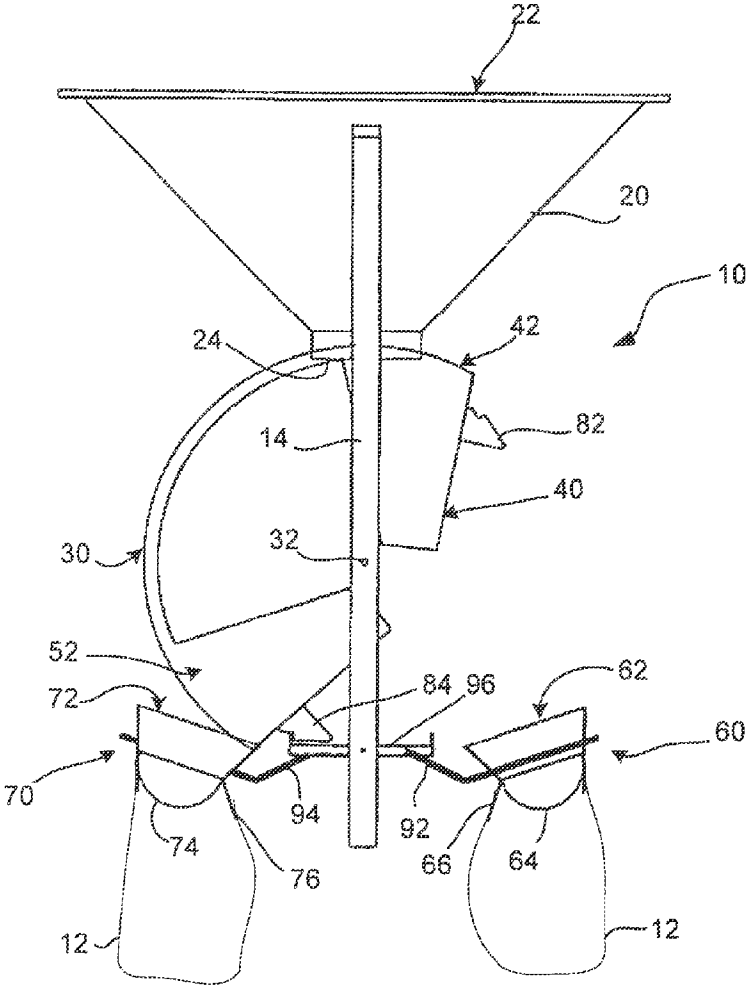
FIG. 2A shows a side view of the aggregate filling apparatus of FIG. 1 in a first position.

FIGS. 2A and 2B illustrate the sandbagging apparatus 10 where an external shroud of the transfer mechanism 28 is removed for purposes of illustration. As shown, the transfer mechanism 28 includes a rotating carriage 30 that is disposed between the supply hopper 20 and the first and second filling stations 60, 70. As illustrated, each of these components is mounted to a free standing frame 14, however, the configuration of the frame may be varied. The carriage 30 is mounted to the frame 14 via a pivot point or rotational axis 32, which allows the carriage 30 to rotate between a first position as illustrated in FIG. 2A, and a second position, as illustrated in FIG. 2B. As shown, the carriage 30 includes a first transfer hopper 40 and a second transfer hopper 50, which are supported on opposing ends of the carriage 30.

Generally, the rotating carriage 30 is operative to alternately move between the first and second positions illustrated in FIGS. 2A and 2B. In this regard, each transfer hopper 40, 50 is alternatively disposed beneath the outlet of the supply hopper 20 to receive sand and then rotated to dump the received sand into a corresponding one of the first and second filling stations 60, 70. Each of the filling stations 60, 70 is generally formed as a hopper that includes an inlet 62, 72 adapted to receive sand from a transfer hopper and funnel that sand through an outlet 64, 74, respectively. Accordingly, a container or bag 12 may be fitted over the outlet 64, 74 of the filling stations 60, 70. In order to maintain a flexible bag on the outlets 64, 74 of the filling stations 60, 70, may include a tongue or lip 66, 76, respectively, that is disposed transverse to a vertical reference axis. This tongue or lip 66, 76 allows for an inside portion of the bag to be engaged therewith as sand passes through the bag filling station and thereby supports a portion of the weight of the sand. In this regard, a person fitting a bag onto the respective bag filling hopper may utilize the tongue or lip to support a portion or all of the weight of the sand as it pours into the bag.

As shown, the supply hopper 20 includes an inlet end 22 and an outlet end 24. In illustrated embodiment, the supply hopper is a container for receiving a bulk material that tapers downward between the inlet end 22 and the outlet end 24. However, it will be appreciated that variations to the supply hopper are considered within the scope of the presented inventions. That is, the supply hopper 20 need not include tapered sidewalls between an inlet and outlet. What is important is that the supply hopper 20 provides a supply of sand or aggregate to the transfer mechanism 28. Further, any appropriate means may be utilized to load the supply hopper 20.

Figure 3B:
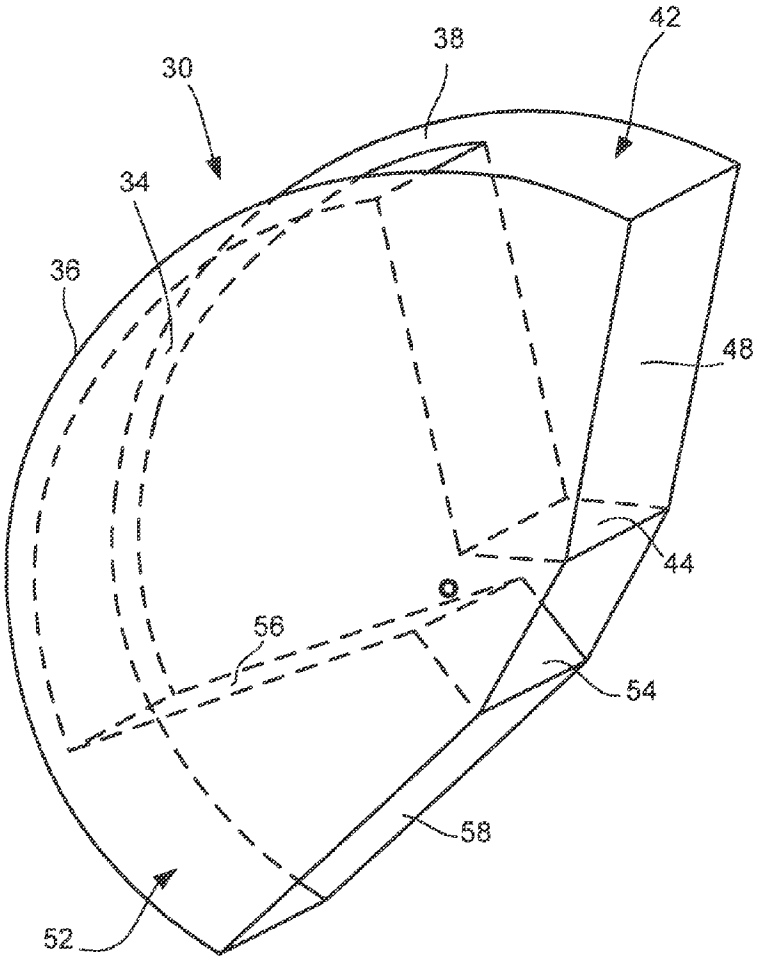
FIGS. 3A and 3B show first and second perspective views of a rotating carriage of the aggregate filling apparatus.
Figure 3A:
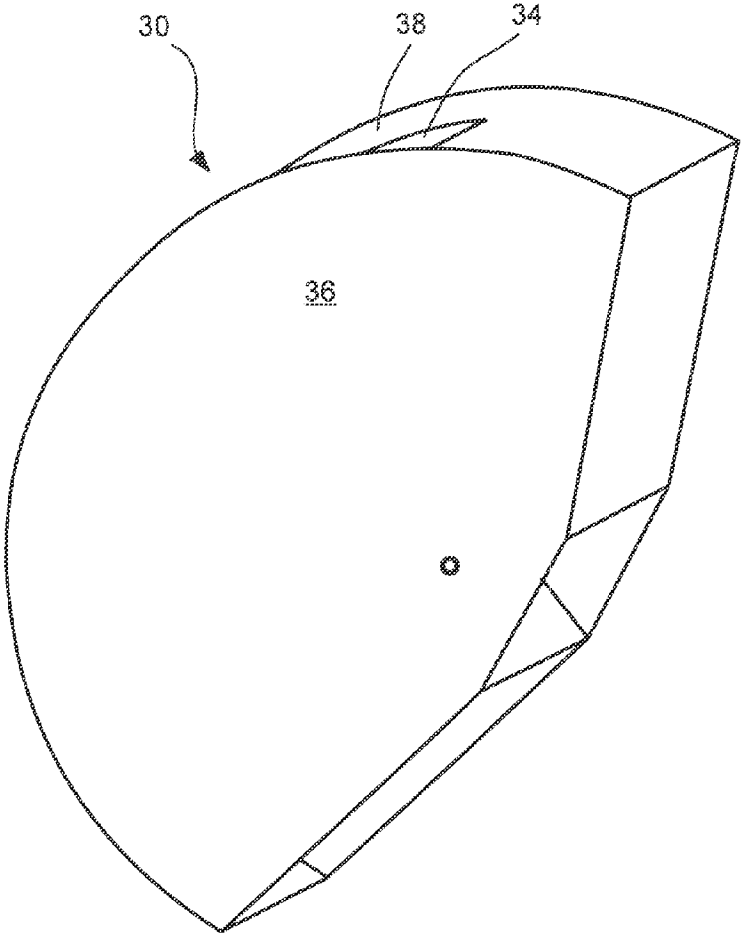

The rotating carriage is further illustrated in FIGS. 3A and 3B. In the illustrated embodiment, the carriage 30 includes first and second face semi-circular plates 36, 38. Of note, the front plate 36 is not illustrated in FIGS. 2A and 2B for purposes of illustration. The first transfer hopper 40 is disposed proximate a first edge of the carriage 30 and includes a first open end 42 and second closed end 44. The second transfer hopper 50 is disposed proximate to a second edge of the carriage 30 and likewise includes a second open end 52 and a second closed end 54. The plates 36, 38 in conjunction with cross-wall 46, end wall 48 and the first closed end 44 collectively define a volume (e.g., first volume) of the first transfer hopper 40. Likewise, the plates 36, 38 in conjunction with cross-wall 56, end wall 58 and the second closed end 54 collectively define the volume (e.g., second volume) of the second transfer hopper 50. The volumes of the first and second transfer hoppers 40, 50 may be sized to hold a predetermined amount of sand received from the supply hopper 20. For instance, the transfer hoppers 40, 50 may be sized to hold an amount of aggregate that corresponds to, for example, the volume of a sand bag or other container that receives sand from the apparatus 10. In one embodiment, the volumes of the transfer hoppers are sized to hold approximately 40 pounds of dry sand. Other volumes may be selected. In any embodiment, the transfer mechanism provides a pre-measured amount (e.g., metered amount) of sand to the filling stations.

Figure 4:
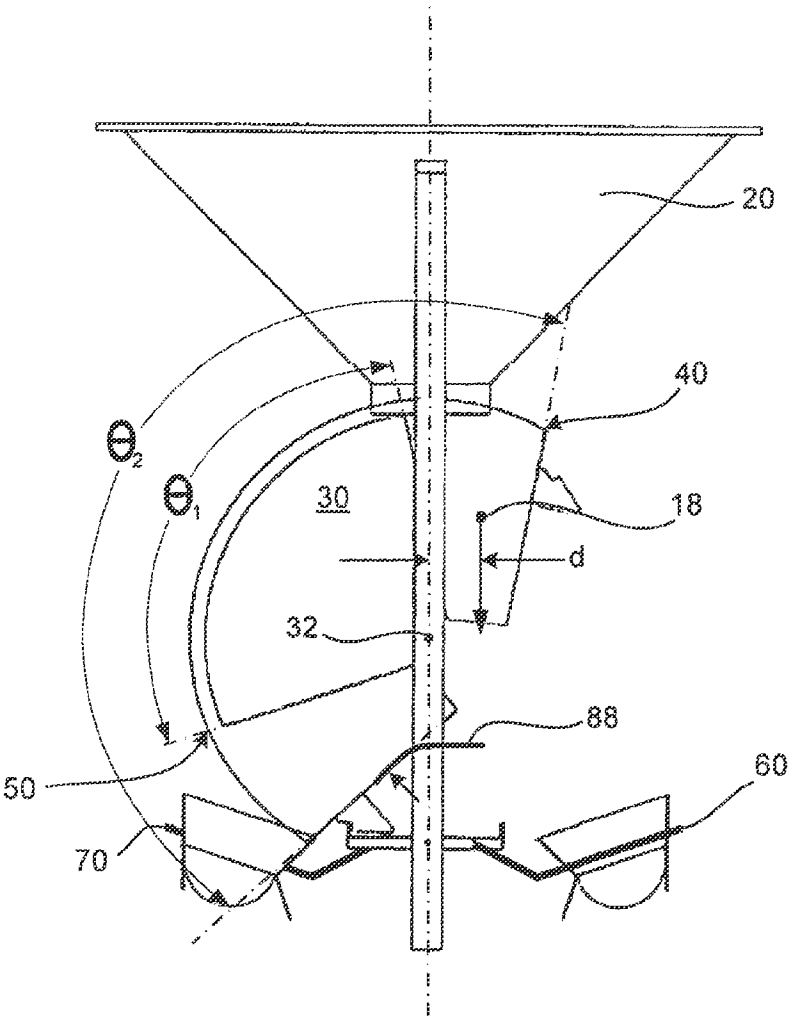
FIG. 4 shows a side view of the aggregate filling apparatus of FIG. 1.

The carriage 30 supports the first and second transfer hoppers 40, 50 at first and second angular positions relative to the rotational axis 32 of the carriage 30. This is illustrated in FIG. 4. In the illustrates embodiment, the inside edges of the first and second transfer hoppers 40, 50 as defined by the inside cross-walls 46, 56 are offset by a first angle $\theta_1$ and the outside edges as defined by the end walls 48, 58 are offset by a second angle $\theta_2$. These angles $\theta_1$ and $\theta_2$ may be the same or different. These angular positions are offset by at least 90°. More preferably, the first and second hoppers are offset by at least 100° and yet more preferably by at least 110°. In any case, it is desirable the angle between the outside edges of the transfer hoppers be greater than 90°. In this regard, when one transfer hopper 40 is positioned substantially upright beneath the outlet 24 of the supply hopper 20 to receive sand, the other transfer hopper 50 is rotated at least partially downward (i.e., the open end 52 and end wall 58 are tilted downward) to allow aggregate material to flow out of the second transfer hopper and into the filling station 70. See also FIG. 2A.

To prevent sand from exiting the outlet 24 of the supply hopper 20 as the carriage rotates between the first and second positions, a radial surface 34 disposed between the face plates 36, 38 extend between the open ends 42, 52 of the transfer hoppers 40, 50. See FIGS. 3A and 3B. In operation, the radial surface 34 is disposed beneath the outlet 24 of the supply hopper 20 as the carriage 30 moves between the first position where the first transfer hopper 40 is disposed beneath the outlet 24 and the second position where the second transfer hopper 50 is disposed beneath the outlet 24. This prevents sand from passing out of the supply hopper 30 while the carriage 30 moves between the first and second positions. Further, in the present embodiment, the radial surface 34 is disposed below the radial edges of the plates 36, 38 such that the plates and radial surface 34 collectively define a channel. Accordingly, any sand that does spill out of the supply hopper 20 during movement of the carriage 30 between first and second positions is channeled into one of the first and second transfer hoppers 40, 50. Further, the edges of the channel defined by the plates 36, 38 may have a width that is substantially equal to the width of the outlet 24. Accordingly, this may prevent leakage of sand out of the front and rear edges of the outlet 24. Further, the side surfaces of the outlet 24 may include a gasket (not shown) that is adapted to engage the radial surface 34. However, this is not a requirement.

The rotating carriage 30 allows filling one transfer hopper 40, 50 while the while the other transfer hopper 40, 50 is tilted to spill sand into one of the filling stations 60, 70. Once the sand is spilled from the tilted transfer hopper and the upright hopper is filled, the carriage rotates to other position, repeating the process. To provide adequate time for users to position bags on the outlets of the bag filling stations 60, 70 the apparatus 10 allows for locking the rotating carriage 30 in the first and second positions. In this regard, the carriage further includes first and second catches 82, 84 that are, in the illustrated embodiment. connected to the carriage proximate to the first transfer hopper 40 and the second transfer hopper 50. See FIGS. 2A and 2B. These catches 82, 84 are adapted to engage corresponding latches 92, 94 disposed proximate to the first and second filling stations 60, 70. As show in FIG. 2A, in the first position, the second catch 84 engages the second latch 94 such that the carriage 30 is maintained in the second position. At this time, sand may drain from the second transfer hopper 50 into the second filling station 70. Once the second transfer hopper 50 is emptied, and a user has positioned a bag on the first filling station 60, the user may release the second latch 94 to allow the carriage 30 to rotate to the second position as illustrated in FIG. 2B. Other latching/locking mechanisms may be utilized.

In the present embodiment, the first and second latches 92, 94 are attached to opposing ends of a common lever 96 that is pivotally interconnected to the frame 14. Various springs may be utilized to maintain a neutral position of the latches 92, 94. When a user of one of the station 60, 70 is ready to receive a filled transfer hopper 40, 50, the user may pull up on their respective filling station 60, 70 to rotate the lever 96 and thereby release the engaged catch 82, 84. Accordingly, this releases the carriage 30 such that it may rotate into position above the filling station. See, e.g., FIG. 2B.

Referring again to FIGS. 2A and 2B, the general operation of the apparatus 10 is described. As illustrated in FIG. 2A, the apparatus may be initially disposed in the first position where the first transfer hopper 40 is rotated beneath the outlet 24 of the supply hopper 20. In this regard, at least a portion of the open inlet end 42 of the first transfer hopper 40 is positioned beneath the outlet 24 of the supply hopper 20. Accordingly, sand within the supply hopper 20 may drain into the first transfer hopper 40. Once the level of the sand within the first transfer hopper 40 reaches the bottom of the supply hopper outlet 24, the flow of sand between the supply hopper 20 and the transfer hopper 40 ceases. In this regard, a predetermined amount of sand is metered into the transfer hopper 40. At this time, a user who has positioned a bag 12 on the first bag filling station 60 may disengage the second catch 94 releasing the carriage 30, which then rotates between the first position illustrated in FIG. 2A and the second position illustrated in FIG. 2B.

The rotation of the carriage between the first and second positions is actuated by the weight of the sand within the transfer hoppers 40, 50. That is, the stored kinetic energy of the sand in a filled transfer hopper supplies the energy to rotate the carriage 30. This is better illustrated in FIG. 4, which shows that a geometric center of volume or centroid 18 of the first transfer hopper 40 is offset a distance 'd' from a vertical reference access A-A that extends through the rotational axis 32 of the carriage 30. As will be appreciated, the center of volume of the first volume 48 of the first transfer hopper 40 also represents the center of mass once that volume 48 is filled with sand from the supply hopper 20. This offset provides part or all of the actuating force required to move the carriage 30 from the first position (see FIG. 2A) to the second position (see FIG. 2B). That is, once the latch 84 is released, the offset weight of the sand rotates the carriage 30 from the first position to the second position allowing the sand within the first transfer hopper 40 to spills into the inlet 62 of the first bag filling station 60. In conjunction with spilling the sand from the first transfer hopper 40 into the first bag filling station 60, the inlet end 52 of the second transfer hopper 50 is positioned beneath the outlet 24 of the supply hopper 20. Accordingly, the second transfer hopper 50 fills with sand, which will likewise provide the energy required to rotate the carriage 30 back from the second position illustrated in FIG. 2B to the first position illustrated in FIG. 2A. Further, once the rotating carriage 30 moves into the second position illustrating in FIG. 2B, the first catch 82 is engaged by the first latch 92 such that the rotating hopper is locked in the second position. Accordingly, weight of the sand in the second transfer hopper 50 does not initiate rotation until the latch 92 is released.

While the weight of the sand within transfer hopper 40 is operative to move the carriage 30 between the first and second positions, it will be appreciated that the sand will extend in a continuous column between the supply hopper and the transfer hopper 40. In order to move the radial surface 34 of the carriage 30 through this continuous column of sand, an initiation force in addition to the kinetic energy of the sand in the upright transfer hopper may be required. In some embodiments, a restoring spring 88 is provided to facilitate the initiation of movement between the first and second positions and vice-versa. As shown in FIG. 4, a cantilevered restoring spring 88 is attached to the frame 14. This restoring spring 88 is engaged by a lateral edge of the carriage 30 in each of the first and second positions. As shown in FIG. 4, in the first position, a leftward end of the restoring spring 88 is deflected. That is, as the carriage 30 moves from the second position to the first position, kinetic energy of the sand in the filled transfer hopper is utilized to deflect the restoring spring 88. A portion of this kinetic energy is stored within the spring 88 once the catch is engaged is by the latch 94 and may be used to initiate movement of the carriage between the first position and the second position. That is, upon releasing the latch 94 the spring 88 applies a restoring force to the carriage that, in conjunction with the weight of gravity acting on the mass in the offset transfer hopper, initiates movement of the carriage between the first position and the second position. Though described as a cantilevered restoring spring, it will be appreciated that any bias force member may be utilized.

Figure 5:
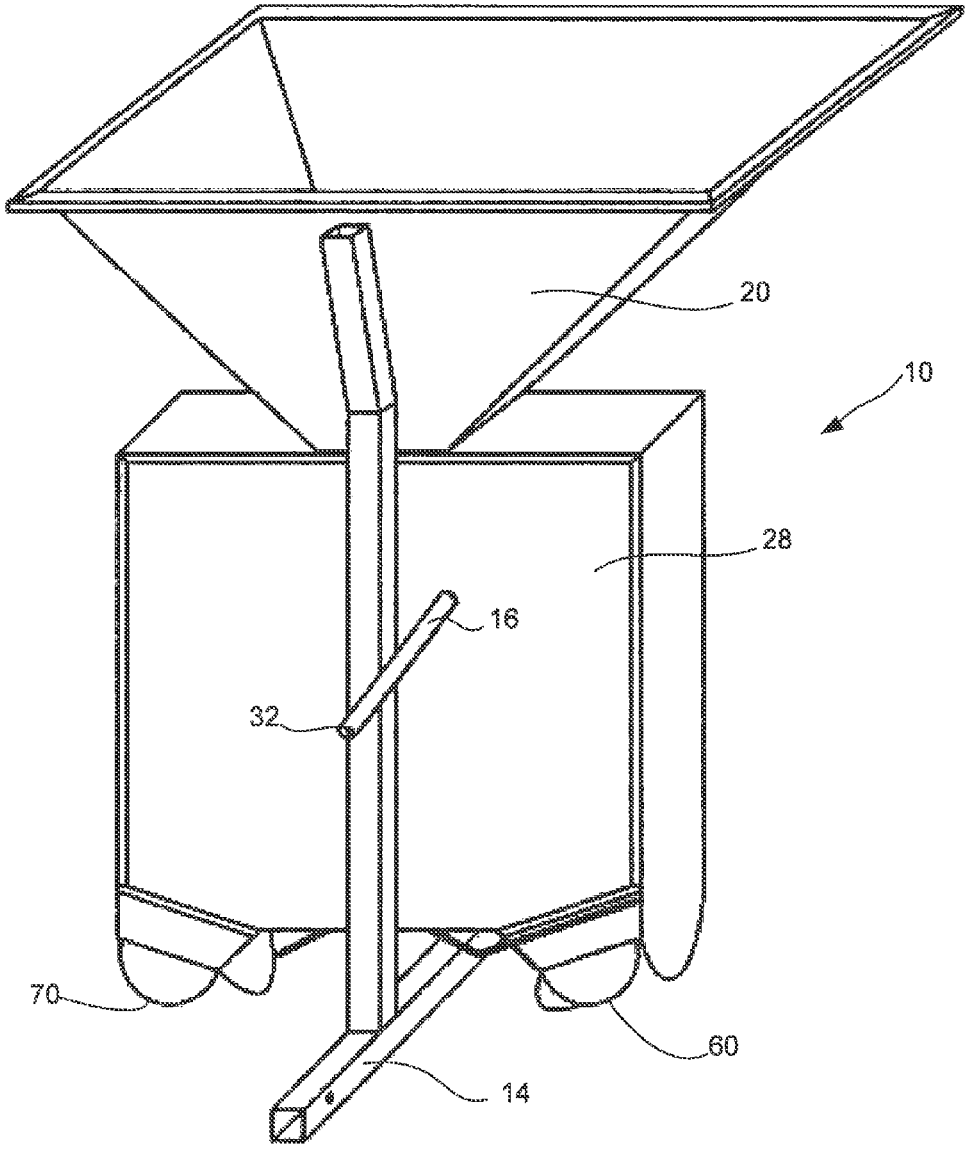
FIG. 5 shows a perspective view of another embodiment of an aggregate filling apparatus.

Variations may be made to the illustrated sand bag filling apparatus. For instance, FIG. 5 illustrates a variation of the apparatus 10 that, rather than utilizing a free standing frame, utilizes a frame 14 that is adapted for attachment to a vehicle. In this embodiment, a lower end of the frame 14 is sized within a receiving hitch of a vehicle. Accordingly, in such an arrangement the sand bag filling apparatus 10 may be mounted on the back of a pickup truck or other vehicle which may be loaded with sand. The apparatus of FIG. 5 also illustrates an alignment or trip lever 16 that connects to the rotational axis of the carriage. This trip lever 16 may be displaced by a user to initially align the carriage beneath the outlet of the supply hopper and/or to initiate movement of the carriage between the first and second positions.

Figure 6:
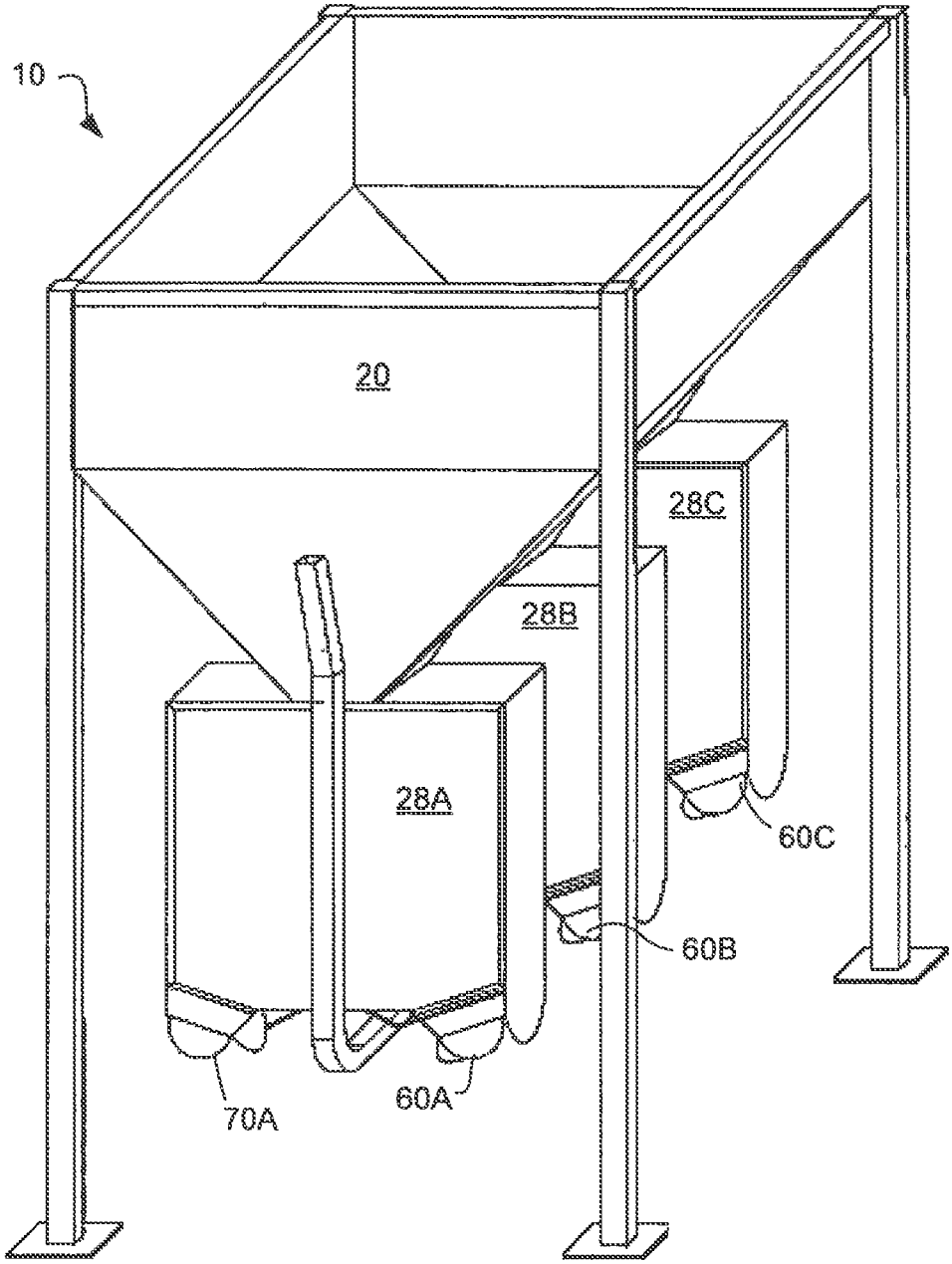
FIG. 6 shows a perspective view of another embodiment of an aggregate filling apparatus.

FIG. 6 illustrates a further embodiment of the apparatus 10 where the supply hopper 20 includes multiple outlets interconnected to multiple transfer devices 28A-28C each having first and second filling stations 60A-C, 70A-C (not all shown). As illustrated, the supply hopper 20 is free standing and supports the multiple transfer devices and filling stations. Further, the length of the supply hopper 20 allows for mechanized filling. For instance, a front end loader or other machinery, may be utilized to fill the hopper. As will be appreciated, the filling stations of each transfer device 28A-C may be utilized individually allowing the simultaneous filling of three sand bags. Though illustrated as having three transfer devices and six filling stations, it will be appreciated that other configurations are possible and within the scope of the present disclosure.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed:

1. An apparatus for filling portable storage containers with aggregate material, comprising:

a supply hopper having an inlet and an outlet;

a first bag filling hopper and a second bag filling hopper, each having an inlet and an outlet; and a carriage located between the supply hopper and the first and second bag filling hoppers, the carriage being movable about an rotational axis between a first position and a second position, said carriage including:

a first transfer hopper, the first transfer hopper having a first open end adapted for alignment with the outlet of the supply hopper in the first position and the inlet of the first bag filling hopper in the second position; and a second transfer hopper, the second transfer hopper having a first open end adapted for alignment with the inlet of the second bag filling hopper in the first position and the outlet of the supply hopper in the second position.

2. The apparatus of claim 1, wherein:

the first transfer hopper further includes a first volume between said first open end and a first closed end; and the second transfer hopper further includes a second volume between said second open end and a second closed end.

3. The apparatus of claim 2, wherein aggregate received from said supply hopper is maintained in said first volume in said first position and flows out of said first open end of said first volume in said second position.

4. The apparatus of claim 2, wherein, in said first and second position of said carriage, a first centroid of said first volume and a second centroid of said second volume are disposed on opposing sides a vertical reference axis passing through said rotational axis of said carriage.

5. The apparatus of claim 1, wherein said carriage supports said first and second transfer hoppers at first and second angular positions about said rotational axis.

6. The apparatus of claim 5, wherein said first and second angular positions are offset by at least 90°.

7. The apparatus of claim 5, wherein said first and second angular positions are offset by at least 100°.

8. The apparatus of claim 5, wherein the carriage further comprises:

a radial surface extending between the first inlet of the first transfer hopper and the second inlet of the second transfer hopper, wherein the radial surface is disposed beneath the outlet of the supply hopper as the carriage moves between the first and second positions.

9. The apparatus of claim 8, further comprising:

at least one seal element attached to at least one edge of said outlet of said supply hopper, wherein said at least one seal element is adapted for engagement with the radial surface as said carriage moves between said first and second positions.

10. The apparatus of claim 1, further comprising:

a first biasing member, wherein the first biasing member is biased by said carriage when the carriage moves to the first position; and a second biasing member, wherein the second biasing member is biased by said carriage when the carriage moves to the second position.

11. The apparatus of claim 10, wherein said first biasing member applies a restoring force to the carriage to displace the carriage from the first position toward the second position, and wherein the second biasing member applies a restoring force to the carriage to displace the carriage from the second position toward the first position.

12. The apparatus of claim 1, further comprising:

a first latch member adapted to engage said carriage in said first position and maintain said carriage in said first position; and a second latch member adapted to engage said carriage in said second position and maintain said carriage in said second position.

13. The apparatus of claim 12, wherein each of said first and second latch members is operable to move between a latching position engaging said carriage and a release position releasing said carriage.

14. The apparatus of claim 1, wherein the outlet of the first and second bag filling hopper further comprises:

a lip disposed transverse to a central axis of the outlet, wherein the lip is adapted to be disposed within a portable storage container.

15. The apparatus of claim 1, further comprising:

a frame supporting said supply hopper, said carriage and said first and second bag filling hoppers.

16. The apparatus of claim 1, wherein said supply hopper comprises a plurality of outlets and further comprises:

a corresponding plurality of sets of first and second bag filling hoppers; and a corresponding plurality of carriages each including first and second transfer hoppers.

17. A method for filling multiple portable storage containers with aggregate material, the method comprising:

filling a supply hopper with an aggregate material, said supply hopper having an inlet end and an outlet end;

draining the aggregate material through said outlet end of said supply hopper into a first open end of a first transfer hopper supported by a rotating carriage, wherein said rotating carriage is in a first position;

rotating the carriage to a second position wherein said first open end of said first transfer hopper engages an inlet of a first bag filling hopper and a second open end of a second transfer hopper supported by the rotating carriage is aligned with said outlet end of said supply hopper;

wherein, in the second position, the aggregate material in said first transfer hopper spills into said first bag filling hopper and aggregate material in said supply hopper drains into the second open end of said second transfer hopper.

18. The method of claim 17, wherein a mass of said aggregate material in said first transfer hopper, acting under gravity, rotates said carriage between said first position and said second position.

19. The method of claim 17, further comprising:

locking said carriage in said second position while the aggregate material in said first transfer hopper spills into said first filling hopper and aggregate material in said supply hopper drains into the second open end of said second transfer hopper.

20. The method of claim 17, wherein:

upon said aggregate material in said first transfer hopper at least partially spilling into said first filling hopper, a mass of said aggregate material in said second transfer hopper, acting under gravity, rotates said carriage between said second position and said first position.

21. The method of claim 17, further comprising:

blocking the outlet end of the supply hopper as said carriage moves between said first and second positions.

* * * * *